United States Patent [19]

Moore et al.

[11] 4,397,425

[45] Aug. 9, 1983

[54] GRINDING APPARATUS

[75] Inventors: Jerry W. Moore; James Allen, both of Shreveport, La.

[73] Assignee: Pennzoil Company, Houston, Tex.

[21] Appl. No.: 150,711

[22] Filed: May 19, 1980

[51] Int. Cl.[3] ..... B02C 19/08

[52] U.S. Cl. ..... 241/169.1; 241/169.2; 241/199.12; 241/205

[58] Field of Search ..... 241/169.2, 169.1, 261, 241/199.11, 199.12, 205

[56] References Cited

U.S. PATENT DOCUMENTS

| | | | |
|---|---|---|---|
| 1,028,663 | 6/1912 | Bauermeister | 241/169.1 |
| 2,602,596 | 7/1952 | Jones et al. | 241/DIG. 27 |
| 2,631,786 | 3/1953 | Morgans et al. | 241/DIG. 27 |
| 3,773,468 | 11/1973 | Hubbard et al. | 241/169.2 |
| 3,897,017 | 7/1975 | Rogers | 241/257 R |
| 4,003,523 | 1/1977 | Doolittle | 241/DIG. 27 |
| 4,209,136 | 6/1980 | Lindén et al. | 241/169.2 |
| 4,303,610 | 12/1981 | Sardisco et al. | 422/61 |

FOREIGN PATENT DOCUMENTS

| | | | |
|---|---|---|---|
| 12058 | of 1848 | United Kingdom . | |
| 2706 | of 1887 | United Kingdom | 241/199 |
| 20024 | of 1890 | United Kingdom . | |

*Primary Examiner*—Mark Rosenbaum
*Assistant Examiner*—Timothy V. Eley
*Attorney, Agent, or Firm*—Lowe, King, Price & Becker

[57] ABSTRACT

A grinding apparatus for thoroughly crushing, particulating and/or fragmenting materials that are firm or soft. The apparatus is particularly suitable for grinding plant leaf tissue. The grinding apparatus includes a rotatable reamer and a cup for receiving the reamer. The reamer has teeth that form a grinding surface, these teeth extending radially outward from a center point of the grinding surface. A second set of teeth form the inner bottom surface of the cup and provide another grinding surface. The cup teeth correspond to the reamer teeth so as to mesh therewith and produce a camming action during rotation of the reamer.

4 Claims, 4 Drawing Figures

GRINDING APPARATUS

BACKGROUND OF THE INVENTION

This invention relates generally to a grinding apparatus and more particularly to a grinding apparatus that is particularly useful for thoroughly grinding, particulating and fragmenting a soft material such as plant leaf tissue.

A material such as plant leaf tissue is soft, and therefore is difficult to grind using a conventional grinder. Prior art grinders of which we are aware do not provide the cutting, dividing, shearing and piercing action in the grinding elements necessary to thoroughly grind, particulate and fragment these materials. Additionally, these grinders do not have a piston-like action which accentuates the cutting, dividing, piercing and shearing action of the grinding elements. Rather, these grinders require the exertion of substantial force by the user to accentuate various of these actions. Illustrative of these grinders is that of British Pat. No. 12,058 (1848) to Herbert, which shows, in FIG. 2, a pestle having V-shaped teeth and a mortar having V-shaped indentations for receiving these teeth. However, the grinding elements of the Herbert patent do not provide a shearing action and fail to provide a piston-like action that accentuates the cutting and other actions thereof. Similar to the grinder of Herbert is that of British Pat. No. 2,706 (1887) to Norcombe. Also exemplary of these grinders is that of British Pat. No. 20,024 (1890) to Newey which shows a crushing surface having V-shaped projections that extend radially outward from a focal point. However, the crushing surface is for a sugar and salt crusher and there is not shown any particular surface for the crushing surface to contact against.

SUMMARY OF THE INVENTION

It is accordingly an object of the present invention to provide a new and improved apparatus for thoroughly grinding, particulating and fragmenting soft materials such as plant leaf tissue.

It is a further object of the present invention to provide a new and improved grinding apparatus that provides a cutting, piercing, dividing and shearing action.

It is a still further object of the present invention to provide a new and improved grinding apparatus that accentuates the cutting, dividing, piercing and shearing action and does not require application of a substantial force by the user to accentuate these actions.

It is an even further object of the present invention to provide a grinding apparatus that is easily grasped by the hand for rotating the reamer.

Other objects and advantages of the present invention will become apparent as the description thereof proceeds.

In satisfaction of the foregoing objects and objectives, a grinding apparatus, in accordance with the invention comprises a rotatable reamer having teeth that form a first grinding surface, and a cup for receiving the reamer. The teeth forming the first grinding surface extend radially outward from a center point of the grinding surface. The inner bottom surface of the cup is formed with teeth that correspond to the reamer teeth so as to mesh with those teeth and to give the grinding apparatus a camming action during rotation of the reamer. The cup teeth provide a second grinding surface.

In the description of the drawing and in the detailed discussion of the invention which follows, there is shown and essentially described only the preferred embodiment of the invention, simply by way of illustration of the best mode contemplated of carrying out the invention. As will be realized, the invention is capable of other and different embodiments, and its several details are capable of modification in various respects, all without departing from the invention. Accordingly, the drawings and description are to be regarded as illustrative in nature, and not as restrictive.

BEST MODE FOR CARRYING OUT THE INVENTION

Figure 1:
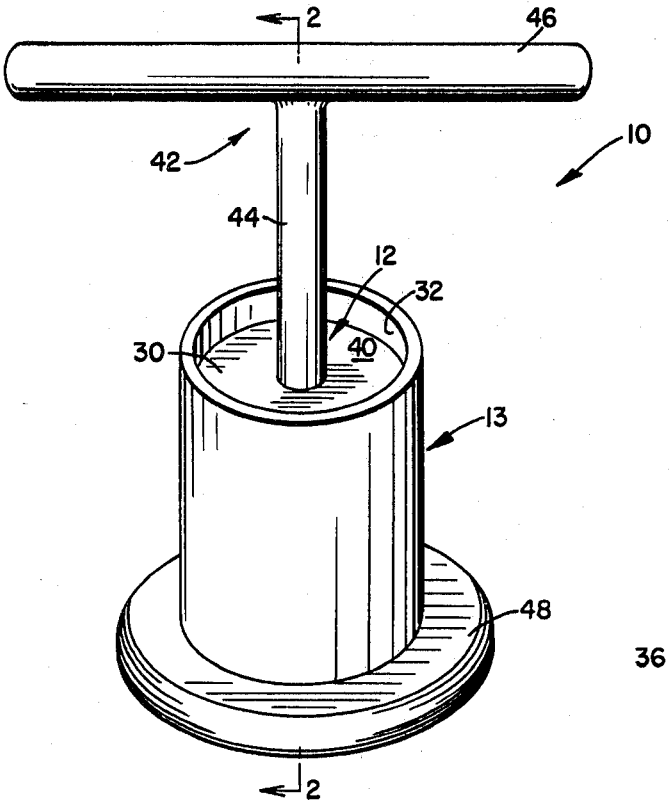
FIG. 1 is a perspective view of the grinding apparatus of the present invention with the rotatable reamer in place within the cup.

Referring to the Figures, a grinding apparatus 10 in accordance with the present invention, comprises a rotatable reamer 12 and a cup 13. Grinding apparatus 10 is useful for thoroughly crushing, particulating and fragmenting both hard and soft materials. The apparatus is particularly useful for particulating and fragmenting soft materials such as plant leaf tissue. Grinding apparatus 10 and this use are disclosed in copending patent application Ser. No. 150,710 of John B. Sardisco and C. O. Phillips, filed May 19, 1980, and entitled "Test Kit for Field Analysis of Plant Tissue Magnesium and Calcium" (now issued as U.S. Pat. No. 4,303,610, Dec. 1, 1981). Reamer 12 has teeth 14 that form a first grinding surface 16. Teeth 14 extend radially outward from a center point 18 of grinding surface 16.

Figure 2:
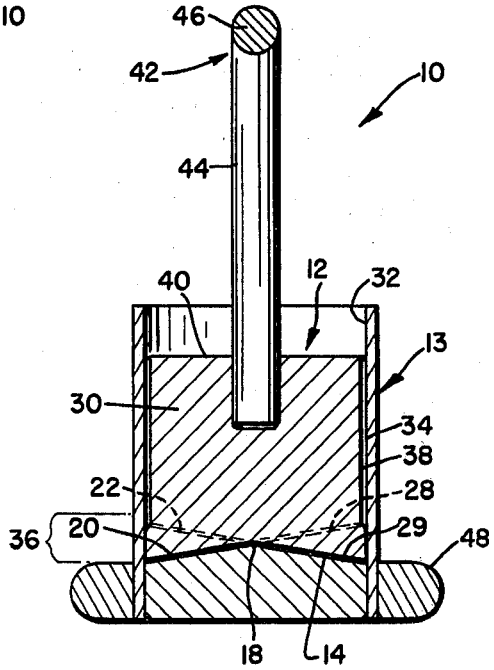
FIG. 2 is a cross-sectional view of the grinding apparatus shown in FIG. 1, taken along the line 2—2 in FIG. 1.

Referring particularly to FIG. 2, the inner bottom surface 20 of cup 13 is formed with teeth 22 that correspond to reamer teeth 14 so as to mesh with those teeth and to give grinding apparatus 10 a camming action when reamer 12 is rotated in cup 13. Cup teeth 22 provide a second grinding surface. It is preferred that cup teeth 22 are identical in shape to reamer teeth 14, and that teeth 22 and teeth 14 have an identical V-shaped configuration. However, teeth 22 and teeth 14 could differ in shape from one another. For example, teeth 22 could be U-shaped and teeth 14 could be V-shaped. Also, teeth 22 and teeth 14 could have an identical U-shaped configuration. Other configurations could be used. However, the cutting and piercing action of grinding apparatus 10 would be substantially reduced by any of these modifications.

V-shaped teeth 14 have peaks 24 and valleys 26, and V-shaped teeth 22 have peaks 28 and valleys 29. The camming action is produced, during rotation of reamer 12, as peaks 24 of reamer teeth 14 move from valleys 29 of cup teeth 22 to peaks 28 of teeth 22 and then return to valleys 29. FIG. 2 shows peaks 24 of teeth 14 in valleys 29 of teeth 22.

Still referring particularly to FIG. 2, it is preferred that body 30 of reamer 12 is cylindrically shaped, and that wall 32 of cup 13 conform to peripheral wall surface 34 of reamer body 30. Thus, reamer 12 and cup 13 are both cylindrically shaped. However, there are less advantageous possibilities. For example, body 30 could be frustoconically shaped and cup 13 cylindrically shaped. Wall surface 34 of reamer body 30 preferably fits snugly against the cup wall 32.

Figure 3:
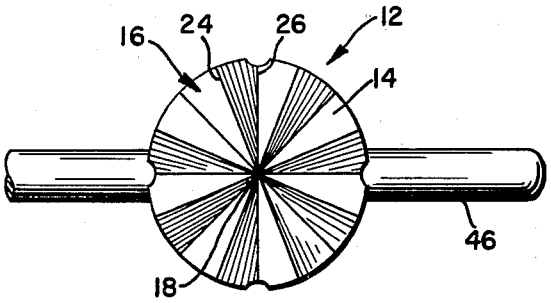
FIG. 3 is an end view of the rotatable reamer of FIG. 1.
Figure 4:
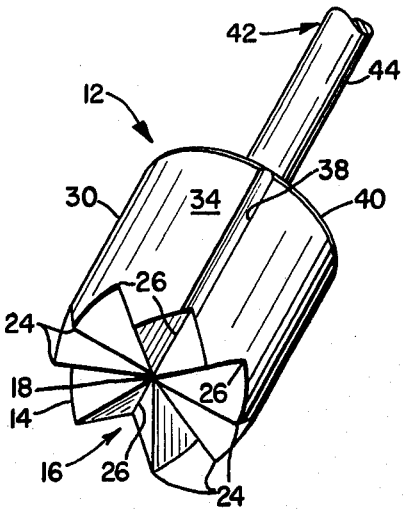
FIG. 4 is a perspective view of the reamer of FIG. 1.

Referring to FIGS. 2, 3 and 4, in order to permit the exit of air from and the entry of air into the bottom portion 36 of cup 13 during insertion of reamer 12 into and removal of reamer 12 from cup 13, as well as during rotation of reamer 12 due to the camming action, it is necessary to provide grooves 38 along wall surface 34, when there is the snug fit. Grooves 38 preferably divide wall surface 34 into four equal parts to permit even air exchange. Three grooves could be used with about equal advantage. Each of grooves 38 extends from top surface 40 of reamer 12 to grinding surface 16. More grooves could be used, but no appreciable advantage results, and fewer than three or four grooves results in less even air exchange, although one groove is adequate.

Referring to FIG. 4, grinding apparatus 10 preferably further includes a T-shaped handle 42 for rotating reamer 12. Handle 42 extends upwardly from top surface 40 of reamer 12 and is preferably perpendicular to top surface 40. Handle 42 is easy to grasp with the hand, for rotating reamer 12. Handle 42 is comprised of an elongated arm element 44 and a cross piece element 46. Other handle configurations could be used. For example, reamer 12 could be rotated by means of an elongated arm such as elongated arm element 44, i.e., no crosspiece is present. This arm could be grasped with the hand for rotating he reamer, could be gear driven, or could be frictionally rotated by a belt driven by a motor. In the latter two instances, grinding apparatus 10 could have a large size and be used commercially. When grinding apparatus 10 does not have a handle such as handle 42, rotation is accomplished, for example, by grasping reamer body 30 with the hand. Handle 42 or any other suitable handle could be removable from reamer body 30 and provided as a separate piece. In this case, the top portion of reamer body 30 would have an aperture that is illustratively square-shaped, into which the lower end of the handle is inserted. The lower end of the handle would match the shape of the aperture. Cup 13 preferably has extended base element 48 to prevent tipping.

In use, the material to be ground is placed inside cup 13 and reamer 12 is then inserted into the cup. Cup 13 is held by one hand of the user, and T-shaped handle 42 is grasped by the user's other hand. Reamer 12 is then rotated and the material is ground. The ground material is removed from the cup by turning the cup upside down and tapping the cup against a surface. A brush may be used to assist removal. Alternatively, a vacuum line is inserted into the cup and the material collected in a bag on the other end of the vacuum line, or a fluid is added to the cup and the ground material washed from the cup. The latter alternative is useful when it is desired to extract the material with the wash fluid or a combination of the wash fluid and an extracting fluid.

In this disclosure there is shown and essentially described only the preferred embodiment of the invention, but as mentioned above, it is to be understood that the invention is capable of changes or modifications within the scope of the inventive concept expressed herein. Several changes or modifications have been briefly mentioned for purposes of illustration.

We claim:

1. A grinding apparatus for thoroughly crushing, particulating and fragmenting soft materials such as plant leaf tissue, comprising:

(a) a rotatable reamer having a substantially cylindrical peripheral wall surface and teeth forming a first grinding surface, said teeth extending radially outward from a center point of said grinding surface;

(b) a cup for receiving said reamer, said cup having an inner bottom surface and substantially straight cylindrical side wall means conforming to the peripheral wall surface of the reamer along a major portion of the reamer during rotation of the reamer within the cup, said peripheral wall surface and cup side wall means each being substantially smooth to provide a snug fitting relationship whereby preventing material from passing between the peripheral wall surface of the reamer and the side wall means, said inner bottom surface formed with teeth defining a second grinding surface and being substantially identical to the teeth of said first grinding surface so as to mesh therewith and provide a camming action during rotation of said reamer relative to the cup, whereby grinding of material placed between the first and second grinding surfaces is effected during rotation of said reamer within the cup;

(c) a groove extending from the top surface of said reamer to said first grinding surface, said groove acting to permit substantially all of the air in the bottom portion of said cup to escape during rotation of said reamer, said air escaping being necessitated by the camming action of said grinding apparatus; and (d) a handle attached to the reamer and projecting longitudinally upwardly therefrom for rotating the reamer within the cup.

2. The grinding apparatus of claim 1, wherein the teeth of said first grinding surface are V-shaped.

3. The grinding apparatus of claim 1, wherein said handle is T-shaped, for ease of grasping by the hand and of rotating said reamer.

4. The grinding apparatus of claim 1, wherein said cup has an extended base element.

* * * * *